United States Patent [19]

Okabayashi

[11] 4,420,750

[45] Dec. 13, 1983

[54] ALPHANUMERIC VISUAL DISPLAY OF THE MATRIX TYPE

[75] Inventor: Naonori Okabayashi, Nara, Japan

[73] Assignee: Sharp Kabushiki Kaisha, Osaka, Japan

[21] Appl. No.: 135,156

[22] Filed: Mar. 28, 1980

[30] Foreign Application Priority Data

Mar. 30, 1979 [JP] Japan ..... 54-39045

[51] Int. Cl.[3] ..... G09G 3/00

[52] U.S. Cl. ..... 340/791; 340/789; 340/792

[58] Field of Search ..... 340/700, 713, 723, 724, 340/748, 750, 765, 768, 784, 792, 794, 798, 799, 805, 789, 791, 790, 802, 763, 764

[56] References Cited

U.S. PATENT DOCUMENTS

| | | | |
|---|---|---|---|
| 2,817,815 | 12/1957 | Evans | 340/802 |
| 3,638,217 | 1/1972 | Sutherland | 340/807 |
| 3,776,364 | 4/1971 | Zanoni | 340/807 |
| 3,778,675 | 12/1973 | Harvey | 340/802 |
| 3,848,250 | 11/1974 | Kashio | 340/765 |
| 3,868,675 | 2/1975 | Firmin | 340/802 |
| 4,163,332 | 8/1979 | Salam | 340/754 |
| 4,247,802 | 1/1981 | Kurokawa | 340/792 |

*Primary Examiner*—Marshall M. Curtis

*Attorney, Agent, or Firm*—Birch, Stewart, Kolasch & Birch

[57] ABSTRACT

An alphanumeric visual display of the matrix type for use in electronic digital wristwatches and similar devices is adapted to display relatively lengthy numerical or character information on a relatively short display area through a consistently varying display fashion. More specifically, display operation takes place in such a manner as to increase an enabled or disabled region (as defined by the number of columns enabled or disabled, respectively) progressively with the passage of time through the utilization of a train of sequentially phase shifted gate signals.

8 Claims, 4 Drawing Figures

ALPHANUMERIC VISUAL DISPLAY OF THE MATRIX TYPE

BACKGROUND OF THE INVENTION

This invention relates to a visual display bearing a matrix type pattern, and more particularly to a display circuit for providing easy-to-read visual indications of various aphanumeric information.

Most of the prior art digital watches include a visual display of the segmented type or other similar types which are not generally considered as fully satisfactory for the purpose of displaying numerical and character information (especially for the latter). To this end various matrix type display panels have been proposed, for example, 5×7 dot matrix display panels and 5×6 dot matrix display panels. However, the use of such matrix type display panels results in an increased number of wiring leads and allows only the provision of visual display of numerical and character information up to five to six digits or characters in hand-held portable devices including digital wristwatches. In order to display relatively lengthy numerical and character information, a changeover switch device is necessary for sharing a common and limited display area.

Provided that the display area is selected each time the changeover switch is actuated, such switch actuation is labor- and time-consuming and the wearer faces difficulty in accurately recognizing information now on the display panel. To avoid this, it has been proposed to change the display mode automatically at a given interval of time upon actuation of the switch device. Such attempt however suffers from an unpleasant situation that information on the display panel changes suddenly even when the switch device is not actuated. Furthermore, quick and repeated change on the display may deteriorate legibility of information on the display panel and inhibit the wearer's recognition thereof.

OBJECTS AND SUMMARY OF THE INVENTION

Accordingly, it is a general object of the present invention to provide an improved matrix type display which is capable of displaying various kinds of numerical and character information under optimum conditions.

A related object is to provide a matrix type display panel which is of significant practical value in eliminating unnatural change on the display panel and facilitating the viewer's recognition of information being displayed.

Briefly, according to the invention a display device assuming a matrix type display pattern is characterized in the provision of means for displaying numerical or character information gradually and continually with the passage of time while an enabled display area (or a disabled display area) selectively increases commensurately and progressively with the passage of time.

BRIEF DESCRIPTION OF THE DRAWINGS

The foregoing as well as other objects, features and advantages of the present invention will become more readily appreciated upon the consideration of the following detailed description of the illustrated embodiments, together with the accompanying drawings, wherein.

DETAILED DESCRIPTION OF THE ILLUSTRATED EMBODIMENT

Figure 1:
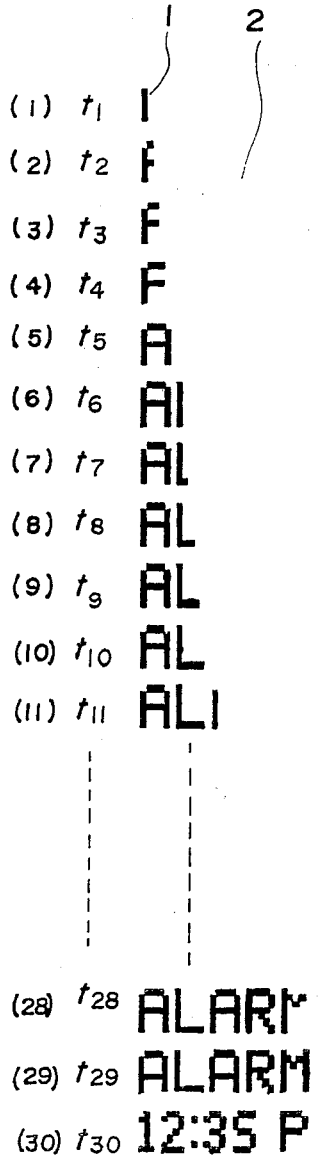
FIG. 1 is an explanation diagram showing an example of a display pattern according to one preferred embodiment of the present invention.

Referring initially to FIG. 1, there is illustrated an exemplary display pattern provided according to one preferred embodiment of the present invention, wherein (1) through (30) depict the developments of the display pattern at time slots $t_1$–$t_{30}$. In FIG. 1, a selected or enabled display region 1 progressively replaces, column by column, a nonselected or disabled display region 2 upon the passage of time, beginning with the extreme left side, thereby progressively completing the displaying of a full length of character or numerical information. In other words, the display pattern progressively changes from time to time during a period of time as defined by a string of time slots $t_1$–$t_{29}$ in the manner of a human being writing letters from the extreme left side. In the illustrated example, the character information ALARM indicative of an alarm display mode is visually displayed on a matrix type display panel. The panel is typically of a 7×29 matrix. After that, display changes at the time slot $t_{30}$ as depicted in (30) so that combined numerical and character information "12:30 P" (12 o'clock 30 minutes p.m.) indicative of the time to be alarmed appears on the display panel.

Figure 2:
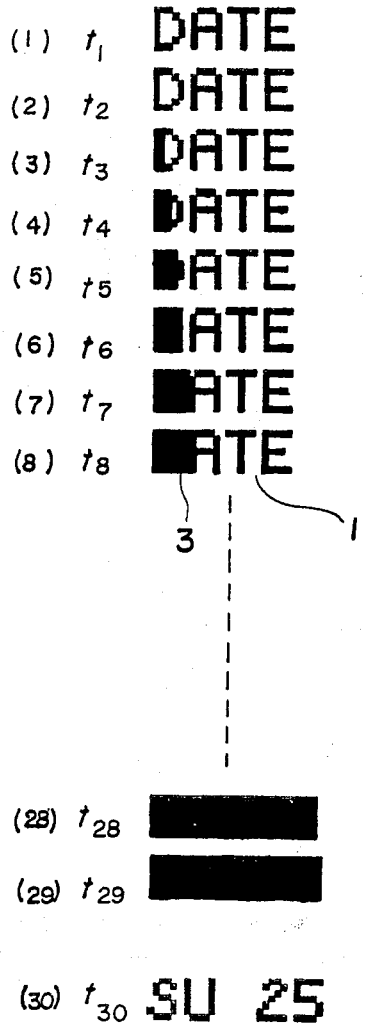
FIG. 2 is an explanation diagram showing an example of a display pattern according to another preferred embodiment of the present invention.

FIG. 2 shows another example of a display pattern wherein the character information DATE indicative of a date and day-of-week display mode is hidden column by column with a black background during the time slots $t_1$–$t_{29}$ designated (1)–(29) in the manner of a human being erasing letters from the extreme left side. Subsequent to this, the date and day-of-week information SU 25 (Sunday 25th day) is visually displayed during the time slot $t_{30}$. In FIG. 2, a background region 3 (nonselected or disabled display area) replaces gradually upon the passage of time, a previously selected or enabled display region 1.

Figure 3:
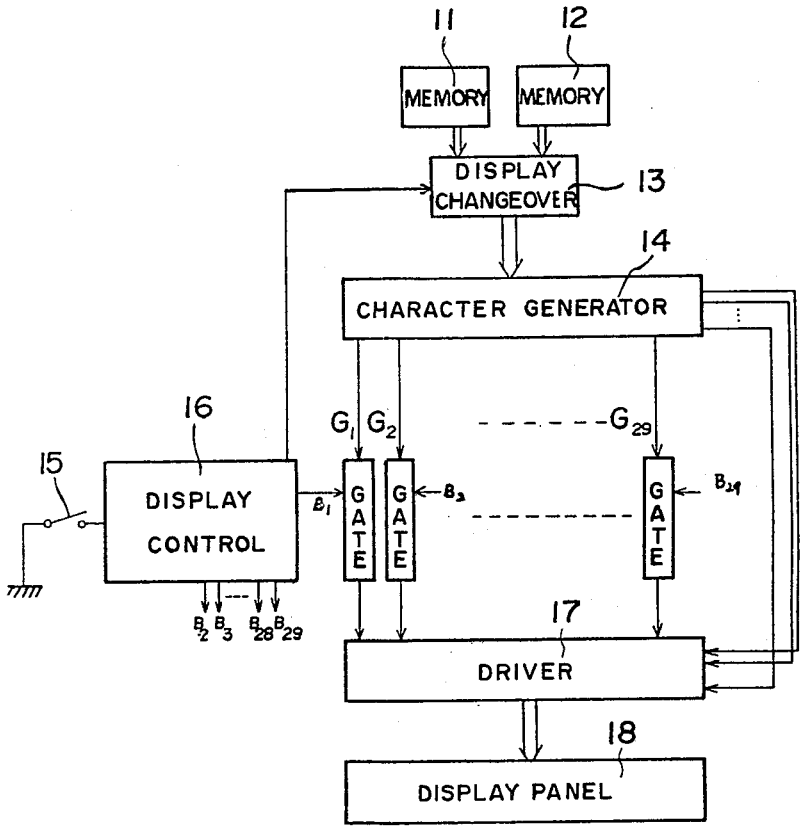
FIG. 3 is a block diagram of display circuitry embodying one preferred form of the present invention.

A specific preferred embodiment of the present invention for realizing the above illustrated display method will now be described with reference to a block diagram of FIG. 3 and a time chart of FIG. 4.

A memory circuit 11 stores alarm time while a second memory circuit 12 stores character information useful in displaying the mode of operation of a utility device such as a digital wristwatch. A display changeover circuit 13 selects either the output of the first memory 11 or that of the second memory 12 and supplies the selected one to a character generator 14. In other words, upon actuation of a switch 15 the output from the memory circuit 12 is selected and then supplied to the character generator 14 under control of a display control circuit 16.

Figure 4:
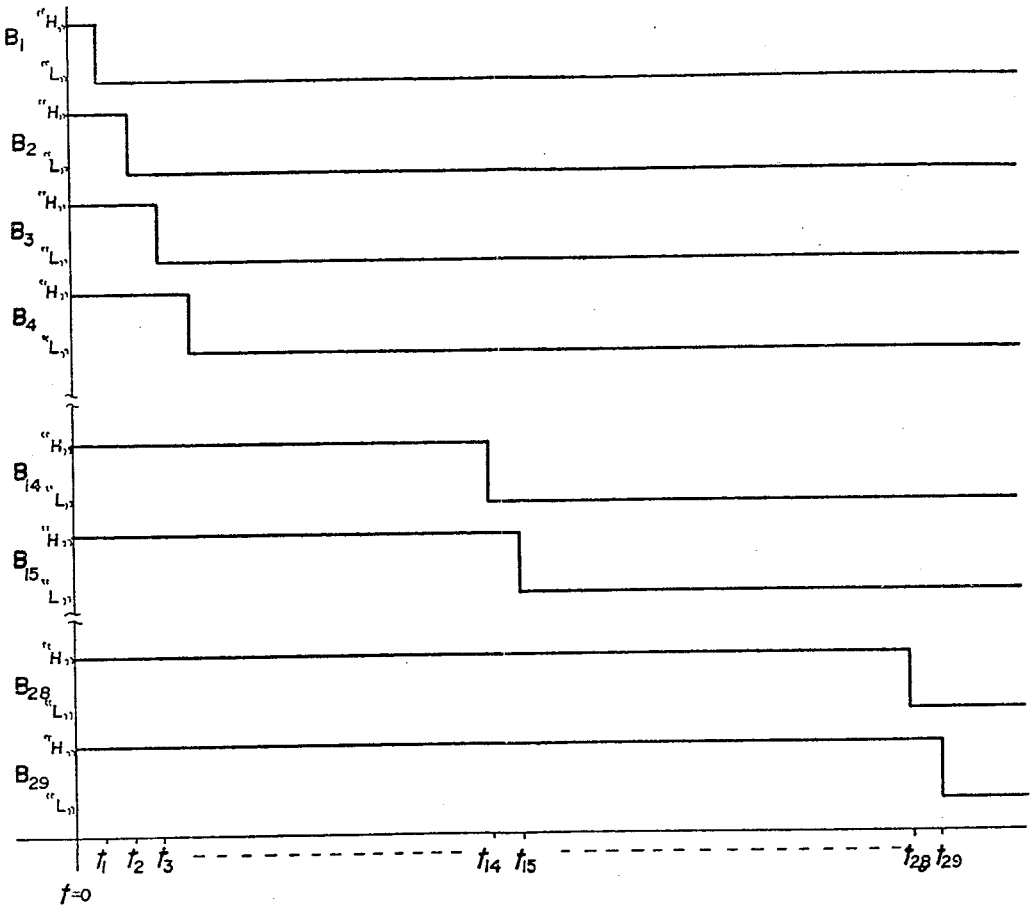
FIG. 4 is a time chart showing waveform of various signals occurring within the circuitry of FIG. 3.

The display control circuit 16 develops a train of disable column specifying signals $B_1$–$B_{29}$ as illustrated in FIG. 4, thus controlling gate circuits $G_1$–$G_{29}$ interposed between the character generator 14 and a driver circuit 17. When one of the disable column specifying signals $B_1$–$B_{29}$ assumes a low level L, its corresponding gate circuit G gates a signal with the same level as the output of the character generator 14. If the specific signal $B_1$–$B_{29}$ assumes a high level H, the gate circuit G provides a low level signal L.

It is evident from a time chart of FIG. 4 that all of the specifying signals are at a high level H at its initial stages and then are lowered one by one to a low level, beginning with the extreme left column, to thereby set their associated columns free from the non-selected or disabled state. The result is that the nonselected or disabled display area 2 is replaced sequentially column by column by the selected or enabled display area 1 to display the contents of the memory circuit 12 in a grandual and progressive manner over the time frame $t_1$–$t_{29}$.

Upon the expiry of a predetermined period of time and at the time slot $t_{30}$, the memory circuit 11 is selected by the display changeover circuit 13 so that all of the disable column specifying signals $B_1$–$B_{29}$ are forced to assume a low level L, allowing the display panel 18 to display the contents of the memory circuit 11.

In applying the principle of the present invention to the display method as shown in FIG. 2, the above mentioned signals $B_1$–$B_{29}$ are used as enabled column specifying signals. For example, if the signals as in FIG. 4 are used to control the gate circuits $G_1$–$G_{29}$, then all that is necessary is to gate the output signals from the character generator 14 as they are when the signals $B_1$–$B_{29}$ are at a high level H. On the contrary, when the signals are at a low level L the output signals of the character generator 14 are fixed at a high level H. Details of the display panel driver circuit are well known in the art as disclosed in S. G. Pitroda U.S. Pat. No. 3,999,050, especially in FIG. 4. with the full disclosure thereof accordingly omitted herein.

The present invention is equally applicable when the enabled column region 1 gradually and progressively replaces the disabled column region 2 in the shown embodiment of FIG. 1 and the disabled column region 3 gradually and progressively replaces the enabled column region 1 in the alternative embodiment of FIG. 2. It is also possible that the visual display at the last time slot $t_{30}$ may continue for a while or change sequentially in the same gradual and progressive manner as described above.

While specific embodiments have been illustrated and described herein the invention is not limited thereto. On the contrary, various modifications, changes and alternatives may occur to those skilled in the art, and the invention includes such changes, modifications and alternatives insofar as they fall within the spirit and scope of the appended claims.

I claim:

1. A display device comprising a display panel having a matrix type display pattern defined by a number of columns, at least two columns being necessary to display each character or number;

a pattern generator; and means responsive to said pattern generator for constraining said display panel to display numerical or character information by sequentially changing column by column the display state of said panel at a perceptible rate to simulate the left to right writing or erasing of said information by a human being, said sequentially changing display state varying the appearance of each character of said display panel while the relative position of each said character on said display panel remains stationary.

2. A display device comprising:

a display panel having a matrix type display pattern defined by a number of columns, at least two columns being necessary to display each character or number;

a pattern generator;

means responsive to said pattern generator for constraining said display panel to display numerical or character information at stationary positions on said display panel, the information on said display panel being sequentially changed column by column with the passage of time while a selected display area on which said display appears increases commensurately and progressively at a perceptible rate with the passage of time said dispalyed information having each character progressively driven to produce said display pattern.

3. A display device comprising:

a display panel having a matrix type display pattern defined by a number of columns and a number of rows, at least two columns being necessary to display each character or number;

a pattern generator; and means responsive to said pattern generator for constraining said display panel to display numerical or character information sequentially column by column with the passage of time at a perceptible rate while an enabled display area as defined by the number of columns increases progressively with the passage of time to simulate the left to right writing of said information by a human being.

4. A display device comprising:

a display panel having a matrix type display pattern defined by a number of columns and a number of rows at least two columns being necessary to display each character or number;

a pattern generator; and means responsive to said pattern generator for constraining said display panel to display numerical or character information sequentially column by column with the passage of time at a perceptible rate while a disabled display area as defined by the number of columns increases progressively with the passage of time to simulate left to right erasing of said information on said display pattern.

5. A display device comprising:

panel means having a matrix type display pattern of a finite length defined by a number of columns in said matrix for displaying numerical and character information at least two columns being necessary to display each character or number;

a pattern generator; and means responsive to said pattern generator for constraining said panel means to progressively and sequentially display said information column by column on said display pattern at a perceptible rate with the passage of time until all of said information has been displayed;

said display of said information proceeding from the extreme left of said panel means in a sequential and progressive manner to simulate the left to right writing of said information by a human being.

6. A display device comprising:

panel means having a matrix type display pattern of a finite length defined by a number of columns in said matrix for displaying numerical and character information, at least two columns being necessary to display each character or number;

a pattern generator; and means responsive to said pattern generator for display said information in sequence and by columns on said display pattern as a stationary image with the passage of time until all of said information has been displayed, and selectively further constraining said panel means to sequentially and progressively erase said information column by column at a perceptible rate from said display pattern with the passage of time until all of said information currently displayed has been erased.

7. A display device comprising:

panel means having a matrix type display pattern of a finite length defined by a number of columns in said matrix for displaying numerical and character information, at least two columns being necessary to display each character or number;

display character generator means for generating character signals representative of said information to be displayed, the application of said signals to said panel means forming an information display;

display control circuit means for developing a plurality of column specifying signals having progressively increasing durations; and means responsive to the column specifying signals developed by said display control circuit means for inhibiting the application of said character signals to said panel means to progressively disable at a perceptible rate increasing portions of said information dispaly.

8. A display device comprising:

panel means having a matrix type display pattern of a finaite length defined by a number of columns in said matrix for displaying numerical, at least two columns being necessary to display each character or number and character information;

display character generator means for generating character signals representative of said information to be displayed, the application of said signals to said panel means forming an information display;

display control circuit means for developing a plurality of column specifying signals having progressively increasing durations; and means responsive to the column specifying signals developed by said display control circuit means for enabling the application of said character signals to said panel means to progressively enable increasing portions of said information display at a perceptible rate.

* * * * *